US009777475B1

(12) United States Patent
Yasinskiy

(10) Patent No.: US 9,777,475 B1
(45) Date of Patent: Oct. 3, 2017

(54) FLOOR VENT

(71) Applicant: Vitaliy Viktorovich Yasinskiy, Vancouver, WA (US)

(72) Inventor: Vitaliy Viktorovich Yasinskiy, Vancouver, WA (US)

( * ) Notice: Subject to any disclaimer, the term of this patent is extended or adjusted under 35 U.S.C. 154(b) by 0 days.

(21) Appl. No.: 15/073,285

(22) Filed: Mar. 17, 2016

(51) Int. Cl.

| | |
|---|---|
| ***E04B 1/70*** | (2006.01) |
| ***E04F 17/00*** | (2006.01) |
| ***E04B 5/48*** | (2006.01) |
| ***F24F 13/08*** | (2006.01) |

(52) U.S. Cl.
CPC ..... *E04B 5/48* (2013.01); *F24F 13/08* (2013.01); *F24F 13/082* (2013.01)

(58) Field of Classification Search
CPC ..... F24F 13/082; F24F 13/105; F24F 13/06; F24F 13/068; F24F 13/12; F24F 13/14; F24F 13/15; F24F 13/16; F24F 13/072; F24F 13/075; F24F 13/08; F24F 2221/40
See application file for complete search history.

(56) References Cited

U.S. PATENT DOCUMENTS 2,587,633 A * 3/1952 Levin ..... F24F 13/08 454/289
3,589,265 A * 6/1971 Hedrick ..... F24F 13/08 454/289
3,786,738 A * 1/1974 Fahre ..... F24F 13/08 454/320
4,770,089 A * 9/1988 Vinicombe ..... B05B 15/1292 118/326
5,163,871 A * 11/1992 Huibregtse ..... F24F 13/08 454/289
5,586,933 A * 12/1996 Sawyer ..... F24F 13/06 454/299
2003/0220070 A1* 11/2003 Orendorff ..... F24F 13/082 454/324
2006/0270336 A1* 11/2006 Ascroft ..... F24F 13/082 454/254

OTHER PUBLICATIONS

1/6-FAMPAT-Questel (Questel-Orbit FamPat patent database), 2 pgs, Feb. 13, 2016.
2/6-FAMPAT-Questel (Questel-Orbit FarnPat patent database), 1 pg, Feb. 13, 2016.
3/6-FAMPAT-Questel (Questel-Orbit FamPat patent database), 1 pg, Feb. 13, 2016.
4/6-FAMPAT-Questel (Questel-Orbit FamPat patent database), 2 pgs, Feb. 13, 2016.
5/6-FAMPAT-Questel (Questel-Orbit FamPat patent database), 2 pgs, Feb. 13, 2016.
6/6-FAMPAT-Questel (Questel-Orbit FamPat patent database), 3 pgs, Feb. 13, 2016.
Welland 4 Inch X 10 Inch Red Oak . . . Vent Cover with Frame & Metal Damper, print-out from amazon.com website Mar. 2, 2016. Print-out; Amazon.com (5 pages) http://www.amazon.com/WELLAND%C2%AE-Flush-Mount-Wood-Damper/dp/B003XHUAJS.
Print-out; Google search (images) (11 pages) https://www.google.com/search?q=air+floor+vents+metal +wood&tbm=isch&imgil=YmMDPidxHSVaCM%253A%253BXNMzPJDimc9nwM%253Bhttp%25253A%2.

* cited by examiner

*Primary Examiner* — Brian D Mattei
(74) *Attorney, Agent, or Firm* — Birdwell & Janke, LLP

(57) ABSTRACT

A floor vent including a grille defining a plurality of vent openings and cross-members therebetween, and one or more pins corresponding to a respective one or more of said cross-members, wherein each of the one or more pins may be either (a) contained within the respective cross-members, or (b) affixed to the respective cross-members, and wherein the one or more pins are formed of material or materials that are substantially stronger than the material or materials of which the respective cross-members are formed, to provide for strengthening the respective cross-members.

21 Claims, 2 Drawing Sheets

Fig. 1 *(PRIOR ART)*
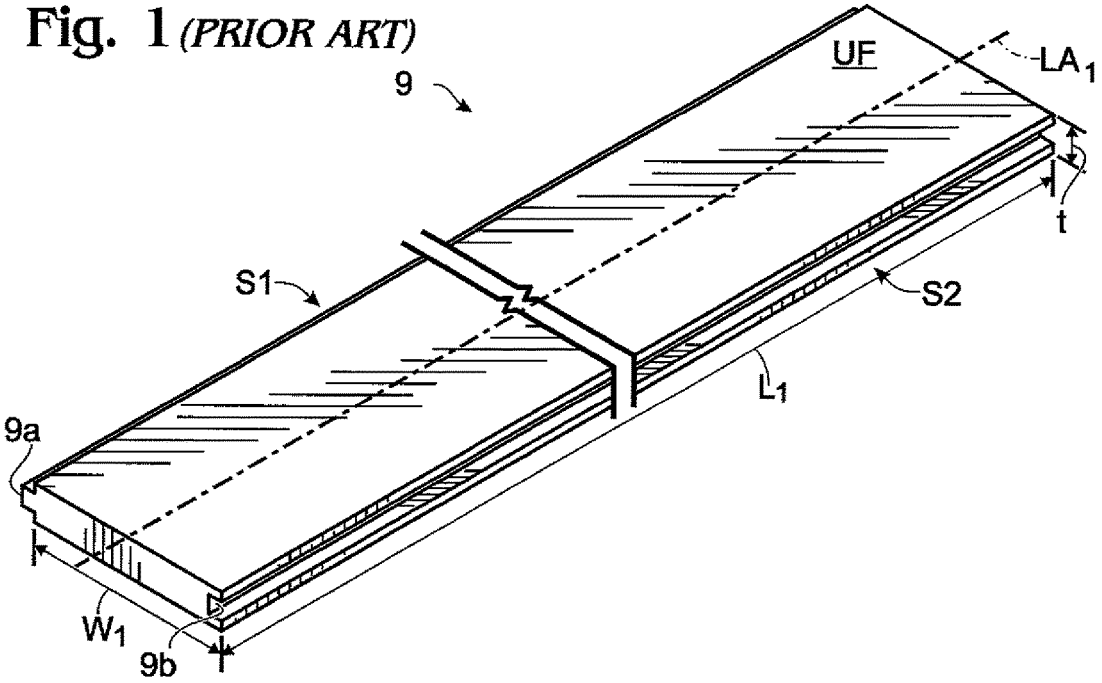
Fig. 3
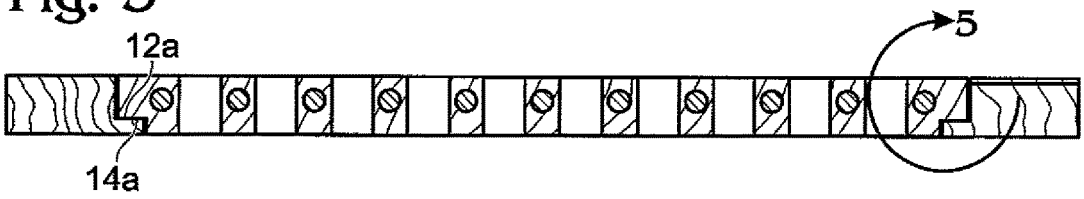
Fig. 4
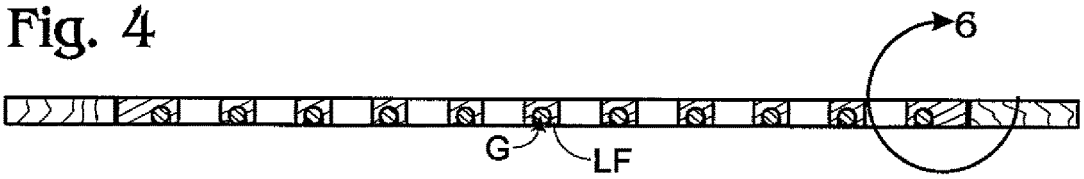
Fig. 5
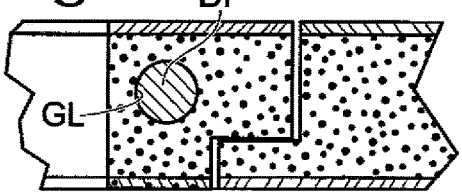
Fig. 6
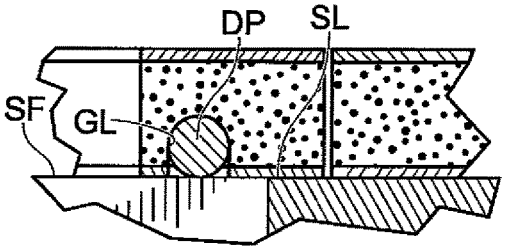

FLOOR VENT

FIELD OF INVENTION

The present invention relates to floor vents, which are used to cover openings, through the sub-flooring and floor coverings in a building such as a house, over ducts which pass air serving the ventilation, heating, and/or air conditioning needs of the building.

BACKGROUND

Floor vents have "grill(e)s" or slatted grates defining a series of openings through the vent to allow for the desired airflow, and corresponding cross-members between the openings. Floor vents are considered decorative items and are intended to be cosmetically appealing. In addition, they may be provided with moving parts that allow for adjusting the direction and/or amount of the airflow through the vent, in which case they are called "registers."

The sub-flooring is typically formed of plywood and the most common types of floor coverings (hereinafter "flooring") are hardwood, engineered hardwood, laminate, carpet, tile, and "linoleum" or polyvinylchloride (PVC). Cork is also sometimes used as a flooring material.

Engineered hardwood flooring is a multi-layer product formed of multiple layers of plywood or fiberboard functioning as a "core" on top of which a real hardwood veneer is provided as a cosmetic surface layer.

Laminate flooring is a multi-layer synthetic product having a surface layer typically having the appearance of wood, but which may be provided to visually simulate other materials as well, by use of a photographic applique.

Both laminate and engineered hardwood flooring are typically relatively thin compared to hardwood flooring, the latter typically having a thickness of ¾ inch, although sometimes being provided in "thin profile" having a thickness of about 5/16 inch. Engineered hardwood typically has a thickness in the range of ⅜ to ⅝ inches, and laminate flooring typically has a thickness in the range of about ¼-½ inch. For a given thickness, neither engineered hardwood flooring nor laminate flooring is as strong as hardwood flooring.

Floor vents are often formed of metal for the sake of both appearance and strength.

For hardwood flooring, it is often considered to be a cosmetically desirable alternative to form the floor vent out of hardwood, and the same type of hardwood so that the vent matches the flooring (it may be noted that such vents typically lack the airflow adjustment feature of a register). Also, at least in the case of hardwood floor vents, it is desirable to have the floor vent be the same thickness as the flooring, to avoid the need to perform a step of routing or chiseling out the sub-flooring. Standard hardwood flooring is typically strong and thick enough to allow for this, providing for sufficiently strong grille cross-members.

Where laminate flooring is used to simulate the appearance of wood, it is also often considered desirable to use a hardwood floor vent. In such cases, it is typically necessary to stain the hardwood floor vent to match the appearance of the laminate, and the hardwood floor vent is typically thicker than the laminate, so it is also typically necessary to perform the aforementioned step of routing or chiseling out the sub-flooring.

SUMMARY

A floor vent is disclosed herein. The floor vent is particularly advantageous for use with laminate, engineered hardwood or cork flooring. The floor vent includes a grille defining a plurality of vent openings and cross-members therebetween, and one or more pins corresponding to a respective one or more of said cross-members, wherein each of the one or more pins may be either (a) contained within the respective cross-members, or (b) affixed to the respective cross-members, and wherein the one or more pins are formed of material or materials that are substantially stronger than the material or materials of which the respective cross-members are formed, to provide for strengthening the respective cross-members.

As the cross-members will typically be formed of material or materials that are substantially free of metal, the one or more pins are preferably formed substantially of metal to provide for strengthening the cross-members.

Preferably the grille are formed of flooring material, either laminate flooring strips, engineered hardwood flooring strips, or cork; and more preferably, the frame and grille are formed of substantially the same material or materials as the flooring.

The floor vent may also include a frame configured to receive the grille as a removable insert.

Where the material or materials of which the grille is formed has a cosmetic flooring side bounded by two opposite sides that are distinct from said cosmetic flooring side, and if the one or more pins satisfy condition (a) the one or more pins are preferably disposed, respectively, within holes that extend through a respective cross-member and through at least one of said opposite sides, and are preferably affixed in the respective holes with an adhesive.

If the one or more pins satisfy condition (b), the one or more pins are preferably disposed, at least partially, within grooves in the respective cross-members, preferably affixed in the respective grooves with an adhesive.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

BRIEF DESCRIPTION OF DRAWINGS

FIG. 1 is an isometric view of a standard strip of flooring material.

FIG. 3 is a cross-sectional view of the floor vent of FIG. 2, taken along a line 2-2 thereof.

FIG. 4 is a cross-sectional view of an alternative embodiment of the floor vent of FIG. 2, taken along the line 2-2.

FIG. 5 is the detail indicated in FIG. 3.

FIG. 6 is the detail indicated in FIG. 4.

DESCRIPTION OF PREFERRED EMBODIMENTS

Figure 2:
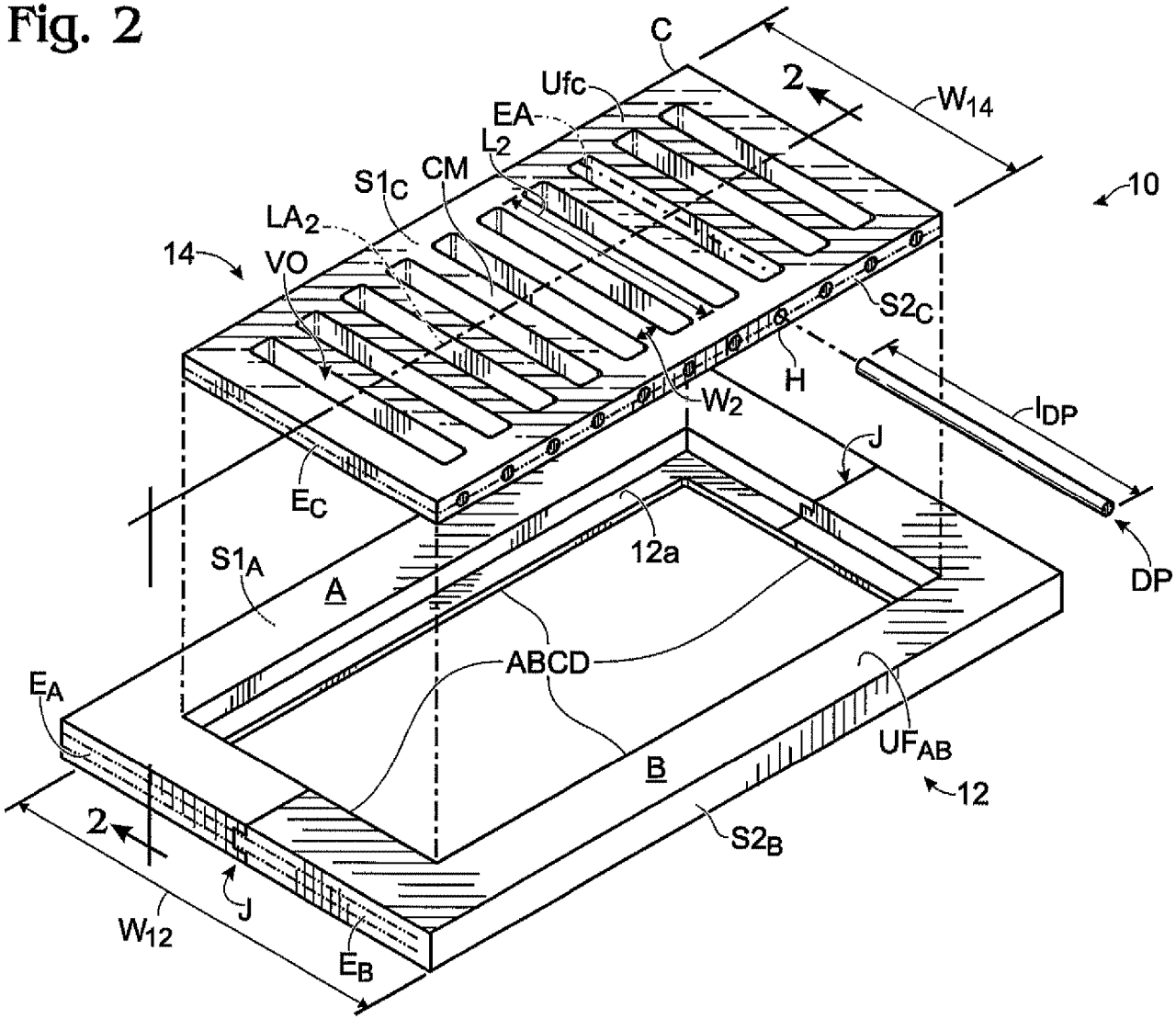
FIG. 2 is an isometric exploded view of a floor vent according to the present invention.

The present inventor has recognized the desirability of forming a floor vent out of the same material that is used for the flooring, to provide a better cosmetic match to the flooring than has previously been provided, for laminate and cork flooring and at least for most engineered hardwood; to provide a floor vent that has the same thickness as such flooring and thereby to obviate the need for routing or chiseling the subflooring; and in the cases of engineered hardwood flooring and laminate flooring that simulates the appearance of wood, to obviate the need for staining a standard hardwood floor vent.

Also recognized by the present inventor is a problem that, as a practical matter, a floor vent should be strong enough to sustain the weight of any furniture that may be placed upon it. More particularly, each of the grille cross-members should be strong enough to sustain a force that may be applied by a chair leg or the like, even during times when someone is sitting in the chair. So forming a floor vent out of flooring that is too thin or otherwise too weak to provide such support is undesirable and, possibly, dangerous.

To solve this problem the present invention provides for a novel means of strengthening the grille cross-members in thin or weak flooring, such as engineered hardwood, laminate and cork flooring.

For reference, FIG. 1 shows a strip 9 of flooring representative of both engineered hardwood and laminate flooring. The strip is elongate and may be considered to define an elongate axis "$LA_1$" along which the strip has a substantially constant cross-section and measured along which the strip has a length "$L_1$." The strip has a width "$W_1$" measured perpendicular to the axis $LA_1$ across an upper face "UF" of the strip, which is the cosmetic face of the strip (e.g., the face supporting a hardwood veneer or a photographic applique); also the strip has a thickness "t" measured perpendicular to the face UF (and the axis $LA_1$). As commercially provided, the length $L_1$ of the strip is substantially greater than the width $W_1$ (e.g., at least 5 times as great); also, the width $W_1$ is substantially greater than the thickness (e.g., at least 5 times as great).

The face UF of the strip 9 is bounded by two distinct and opposite sides of the strip, "S1" and "S2." One of these sides has a "tongue" 10*a*, and the other side has a mating "groove" 10*b*, so that each one of a plurality of substantially identical strips can be interlockedly joined side-by-side, to another one of the strips, by inserting the tongues of the strips into the respective grooves of the adjacent strips, to allow for covering the surface of the floor on which the flooring is being applied.

FIG. 2 shows a floor vent 10 according to the invention. The floor vent 10 is preferably, though not necessarily, formed of two separable parts, a frame surround 12 and a removable grille insert 14 (the grille insert may be provided without a frame). For use with engineered hardwood or laminate flooring, each part is formed of one or more strips of the same flooring, like that shown in FIG. 1. In the example shown in FIG. 2, the strip (or strips) of the flooring used for the frame surround 12 is provided in two pieces "A" and "B" that are joined together by use of the existing tongue-and-groove structures, at joints "J" that are preferably strengthened by the addition of an adhesive (not shown). This allows for a width "$W_{12}$" of the floor vent 10 that is up to twice the aforementioned width $W_1$ of an individual strip. Larger widths $W_{12}$ may be provided by similar application of additional pieces.

For use with cork flooring, each part is, respectively, preferably cut out of, or is in some other manner removed from, a sheet of cork flooring as a unitary whole.

The frame surround 12 thus has an upper face "$UF_{AB}$" that corresponds to the upper face UF of the strip 10 shown in FIG. 1, which is bounded by two distinct and opposite sides "$S1_A$" and "$S2_B$" corresponding, respectively, to the side "S1" of the strip 10, and the side "S2" of either the same strip 10 or a second, similar strip.

The grille insert 14 may likewise be formed of more than one piece of the flooring, but as shown it can be formed of one piece "C" because it has a width "$W_{14}$" that is less than or equal to the width a single strip, rendering it unnecessary to join two (or more) pieces together to provide for additional width.

The grille insert 14 thus has an upper face "$UF_C$" that corresponds to the upper face UF of the strip 10 shown in FIG. 1, which is bounded by two distinct and opposite sides "$S1_C$" and "$S2_C$" corresponding, respectively, to the sides S1 and S2 of the strip 10.

Formed as described, the frame surround 12 and the grille insert 14 have the same thickness, i.e., the aforementioned thickness t.

The frame surround 12 may be machined, preferably by use of a CNC milling machine or router, to provide a ledge surface 12*a* for supporting the grille 14, if the flooring is thick enough to allow for it. Laminate flooring is typically too thin to allow for the ledge surface 12*a*.

Likewise, with reference to FIG. 3, the grille insert 14 may be machined to provide a corresponding relief surface 14*a* for resting on the ledge surface 12*a*. The ledge and relief surfaces provide for additional mechanical stability of the grille insert 14 in the frame surround 12.

As installed on a sub-floor, the frame surround 12, including the ledge 12*a* if provided, is preferably fully supported by the sub-floor, so that the vent hole through the sub-floor (not shown) for the ventilation duct is within the area defined by the rectangle indicated as "ABCD."

The grille insert 14 is also machined, preferably by use of a CNC milling machine or router, to form a series of elongate vent openings "VO" therethrough, which define a corresponding series of elongate cross-members "CM" disposed above the aforementioned vent hole through the sub-floor opening. There are typically at least 10 vent openings in a floor vent to provide for adequate ventilation.

The width of a cross-member is indicated in FIG. 2 as "$W_2$," and the length as "$L_2$," measured, respectively, parallel and perpendicular to the axis "$LA_2$." $L_2$ is generally in the range of about 3-5 inches, more particularly nominally 3½-4½ inches, and most typically about 4 inches long. $W_2$ is typically about or nominally ⅛ inch, and a minimum of about ¼ inch. The vent openings are typically as wide or wider than the cross-members, providing for an open area of between about 14 and 16 square inches, and an airflow between about 45 and 60 cubic feet per minute.

According to the invention, the cross-members CM are strengthened, preferably by the use of respective pins or "dowel pins" DP. In a first embodiment, which is shown in FIGS. 2, 3 and 5, where the thickness of the flooring strips is sufficiently large, holes "H" are drilled through the grille insert 14, through at least one of the sides (which need not be the same side for all of the pins) of the sides $S1_C$ and $S2_C$, the holes having a sufficiently large diameter to accept the dowel pins, which are preferably no larger than 3/16 inch nominal diameter, and are preferably ⅛ inch nominal diameter.

In a second embodiment, which is shown in FIGS. 4 and 6, where the thickness of the flooring strips is too small to allow for disposing them within the holes H, the holes H may be replaced with grooves G formed into the cross-members CM at lower faces "LF" thereof, and the dowel pins may be fully or partially contained within the grooves. It is not necessary that the grooves extend to either of the sides $S1_C$ or $S2_C$.

In the second embodiment, the frame 12 typically has no ledge surface 12*a* and the grille 14 has no corresponding relief surface 14*a*. Rather, a sub-flooring ledge surface "SL" as indicated in FIG. 6 is left remaining around the vent hole through the sub-flooring, in the same manner that the ledge surface 12*a* is provided around the hole through the frame 12 defined by the rectangle ABCD (FIG. 1), and the dowel pins are preferably at an elevation relative to the grille insert 14 that permits them to bear on the ledge surface SL when the grille is installed.

In both embodiments the dowel pins are preferably set parallel to the cross-members.

Preferably the dowel pins are formed of metal, preferably steel, and more preferably 1018 cold rolled steel round stock, which is available in ⅛ inch nominal diameter size from the Fastenal Company of Winona, Minn. However, the dowel pins could be formed of any material providing sufficient strength that is able to fit within a hole or into a groove as described above, which for reference purposes preferably has a yield strength that is at least 80% that of mild steel.

The dowel pins are preferably affixed in the holes or grooves, as the case may be, by an adhesive (indicated in the drawings as "GL"). In the case where the dowel pins are affixed in holes, the adhesive is preferably a general purpose construction adhesive, such as DAP® StrongStik® Heavy Duty All-Purpose Construction Adhesive, available from DAP Products, Inc. based in Baltimore, Md. In the case where the dowel pins are affixed in grooves, the adhesive is preferably an epoxy, such as Gorilla® epoxy, available from The Gorilla Glue Company based in Cincinnati, Ohio. Preferably, the strength of each cross-member is such that the cross-member can elastically sustain a 90 pound force disposed thereon so as to subject the cross-member to a maximum of bending moment.

It is not essential that the lengths "$l_{DP}$" of the dowel pins all be equal, or that any of them span the entire distance between the sides $S1_C$ and $S2_C$ or even the entireties of the lengths of the cross-members CM. But it is preferable to provide for all of these features, to maximize ease of assembly and strength.

Both the frame surround 12 and the grille insert 14 are also preferably machined, preferably by use of a CNC milling machine or router, to remove the tongues and grooves of the strip or strips from which they were provided, leaving flat the sides $S1_A$, $S2_B$, $S1_C$ and $S2_C$. Any or all of these unfinished sides, and any or all of the unfinished ends $E_A$, $E_B$ and $E_C$ (only one of each of which is visible in the Figure) may be finished by staining, but as they are not visible most of the time this is not considered important.

The floor vent 10 may be installed in existing flooring by routing or cutting a hole in the flooring into which the floor vent may be inserted. It is preferable to provide a specially adapted template for this purpose.

It is to be understood that, while a specific floor vent has been shown and described as being preferred and for use with laminate flooring, variations may be made, in addition to those already mentioned, and any of these may be used with other types of flooring, without departing from the principles of the invention. For example, the frame and grille could be provided as a unitary whole, i.e., it is not essential that the grille be separable from the frame. Also, although floor vents are typically rectangular, this is not an essential feature of the disclosed floor vent.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A method for forming a floor vent from one or more existing pieces of a flooring material which is ordinarily used for covering a floor, each of the one or more existing pieces of the flooring material having a substantially planar cosmetic upper face, a substantially parallel and substantially planar opposed lower face adapted for making contact with the floor when the flooring material is applied thereto, and a substantially uniform thickness measured in a thickness dimension that is perpendicular to the faces of the flooring material, the method comprising:

providing a grille insert formed of one or more of the existing pieces of the flooring material, the grille insert having a substantially planar cosmetic upper face and a substantially parallel and substantially planar opposed lower face that are formed, respectively, of the upper and lower faces of the one or more existing pieces of the flooring material of which the grille insert is formed, wherein the grille insert has a substantially uniform thickness measured in a thickness dimension of the grille insert that is perpendicular to the faces of the grille insert, forming in the grille insert a plurality of vent openings and cross-members therebetween, the vent openings extending in a lateral dimension parallel to the faces of the grille insert;

forming respective apertures or grooves in the cross-members that extend laterally beyond the respective openings;

providing a plurality of elongate structural members, each elongate structural member having opposed terminal ends, the elongate structural members formed of material or materials that are substantially stronger than the flooring material; and disposing the one or more elongate structural members in respective ones of the apertures or grooves to strengthen the cross-members so that at least the terminal ends of the elongate structural members do not project in the thickness dimension of the grille insert substantially beyond either of the faces thereof, thereby allowing for applying selected pieces of the existing pieces of the flooring material to a selected floor and installing the grille insert over a vent hole through the selected floor so that the upper face of the grille insert lies flush with the upper faces of the selected pieces.

2. The method of claim 1, further comprising applying the selected pieces of the existing pieces of the flooring material to the selected floor and installing the grille insert over the vent hole so that the upper face of the grille insert lies flush with the upper faces of the selected pieces.

3. The method of claim 1, wherein said step of providing comprises obtaining the grille insert from a single one of the one more existing pieces of the flooring material, in which case the grille insert has a substantially planar cosmetic upper face and a substantially parallel and substantially planar opposed lower face that are the same as, respectively, the upper and lower faces of the single one of the one or more existing pieces of the flooring material, or by joining two or more of the existing pieces of the flooring material together, so that the grille insert has a substantially planar cosmetic upper face and a substantially parallel and substantially planar opposed lower face that are formed, respectively, of the upper and lower faces of the two or more existing pieces of the flooring material.

4. A floor vent, comprising a grille insert formed of one or more existing pieces of a flooring material which is ordinarily used for covering a floor, each of the one or more existing pieces of the flooring material having a substantially planar cosmetic upper face, a substantially parallel and substantially planar opposed lower face adapted for making contact with the floor when the flooring material is applied thereto, and a substantially uniform thickness measured in a thickness dimension perpendicular to the faces of the flooring material, the grille insert formed of one or more of the one more existing pieces of the flooring material, the grille insert having a substantially planar cosmetic upper face and a substantially parallel and substantially planar opposed lower face that are formed, respectively, of the upper and lower faces of the one or more existing pieces of the flooring material of which the grille insert is formed, wherein the grille insert has a substantially uniform thickness measured in a thickness dimension of the grille insert that is perpendicular to the faces of the grille insert, the grille insert having formed therein a plurality of vent openings and cross-members therebetween, the vent openings and cross-members extending in a lateral dimension parallel to the faces of the grille insert, the cross-members having formed therein respective apertures or grooves that extend laterally beyond the respective openings; and a plurality of elongate structural members each having opposed terminal ends, the elongate structural members formed of material or materials that are substantially stronger than the flooring material, wherein the one or more elongate members are disposed in respective ones of the apertures or grooves of the grille insert to strengthen the cross-members of the grille insert and at least the terminal ends of the elongate structural members do not project in the thickness dimension of the grille insert substantially beyond either of the faces thereof.

5. The floor vent of claim 4, wherein no portions of the elongate structural members project in the thickness dimension substantially beyond either of the faces of the grille insert.

6. The floor vent of claim 5, wherein the grille insert is formed of a single one of the one more existing pieces of the flooring material, in which case the grille insert has a substantially planar cosmetic upper face and a substantially parallel and substantially planar opposed lower face that are the same as, respectively, the upper and lower faces of the single one of the one or more existing pieces of the flooring material, or the grille insert being formed by joining two or more of the existing pieces of the flooring material together, so that the grille insert has a substantially planar cosmetic upper face and a substantially parallel and substantially planar opposed lower face that are formed, respectively, of the upper and lower faces of the two or more existing pieces of the flooring material.

7. The floor vent of claim 6, wherein the grille insert has a maximum width measured in a first lateral dimension parallel to the faces of the grille insert and a maximum length measured in a second lateral dimension parallel to the faces of the grille insert distinct from the first lateral dimension, the floor vent further comprising a frame formed of one or more of the existing pieces of the flooring material, the frame having a substantially planar cosmetic upper face, a substantially parallel and substantially planar opposed lower face that are formed, respectively, of the upper and lower faces of the one or more existing pieces of the flooring material of which the frame is formed, the frame having a substantially uniform thickness measured in a thickness dimension perpendicular to the faces of the frame, the thickness of the frame being the same as the thickness of the grille insert, the frame having an insert-receiving opening therethrough, the insert-receiving opening having a minimum width measured in a third lateral dimension parallel to the faces of the frame and a minimum length measured in a fourth lateral dimension parallel to the faces of the frame distinct from the third lateral dimension, wherein the minimum width and minimum length of the insert-receiving opening of the frame is sufficient, relative to the corresponding maximum width and maximum length of the grille insert, to receive the grille insert so that the faces of the frame are co-planar with the corresponding faces of the grille insert.

8. The floor vent of claim 7, wherein the elongate structural members comprise metal and the flooring material does not comprise metal.

9. The floor vent of claim 6, wherein the elongate structural members comprise metal and the flooring material does not comprise metal.

10. The floor vent of claim 5, wherein the grille insert has a maximum width measured in a first lateral dimension parallel to the faces of the grille insert and a maximum length measured in a second lateral dimension parallel to the faces of the grille insert distinct from the first lateral dimension, the floor vent further comprising a frame formed of one or more of the existing pieces of the flooring material, the frame having a substantially planar cosmetic upper face, a substantially parallel and substantially planar opposed lower face that are formed, respectively, of the upper and lower faces of the one or more existing pieces of the flooring material of which the frame is formed, the frame having a substantially uniform thickness measured in a thickness dimension perpendicular to the faces of the frame, the thickness of the frame being the same as the thickness of the grille insert, the frame having an insert-receiving opening therethrough, the insert-receiving opening having a minimum width measured in a third lateral dimension parallel to the faces of the frame and a minimum length measured in a fourth lateral dimension parallel to the faces of the frame distinct from the third lateral dimension, wherein the minimum width and minimum length of the insert-receiving opening of the frame is sufficient, relative to the corresponding maximum width and maximum length of the grille insert, to receive the grille insert so that the faces of the frame are co-planar with the corresponding faces of the grille insert.

11. The floor vent of claim 10, wherein the elongate structural members comprise metal and the flooring material does not comprise metal.

12. The floor vent of claim 5, wherein the elongate structural members comprise metal and the flooring material does not comprise metal.

13. The floor vent of claim 4, wherein the grille insert is formed of a single one of the one more existing pieces of the flooring material, in which case the grille insert has a substantially planar cosmetic upper face and a substantially parallel and substantially planar opposed lower face that are the same as, respectively, the upper and lower faces of the single one of the one or more existing pieces of the flooring material, or the grille insert being formed by joining two or more of the existing pieces of the flooring material together, in which case the grille insert has a substantially planar cosmetic upper face and a substantially parallel and substantially planar opposed lower face that are formed, respectively, of the upper and lower faces of the two or more existing pieces of the flooring material.

14. The floor vent of claim 13, wherein the grille insert has a maximum width measured in a first lateral dimension parallel to the faces of the grille insert and a maximum length measured in a second lateral dimension parallel to the faces of the grille insert distinct from the first lateral dimension, the floor vent further comprising a frame formed of one or more of the existing pieces of the flooring material, the frame having a substantially planar cosmetic upper face, a substantially parallel and substantially planar opposed lower face that are formed, respectively, of the upper and lower faces of the one or more existing pieces of the flooring material of which the frame is formed, the frame having a substantially uniform thickness measured in a thickness dimension perpendicular to the faces of the frame, the thickness of the frame being the same as the thickness of the grille insert, the frame having an insert-receiving opening therethrough, the insert-receiving opening having a minimum width measured in a third lateral dimension parallel to the faces of the frame and a minimum length measured in a fourth lateral dimension parallel to the faces of the frame distinct from the third lateral dimension, wherein the minimum width and minimum length of the insert-receiving opening of the frame is sufficient, relative to the corresponding maximum width and maximum length of the grille insert, to receive the grille insert so that the faces of the frame are co-planar with the corresponding faces of the grille insert.

15. The floor vent of claim 14, wherein the elongate structural members comprise metal and the flooring material does not comprise metal.

16. The floor vent of claim 13, wherein the elongate structural members comprise metal and the flooring material does not comprise metal.

17. The floor vent of claim 4, wherein the grille insert has a maximum width measured in a first lateral dimension parallel to the faces of the grille insert and a maximum length measured in a second lateral dimension parallel to the faces of the grille insert distinct from the first lateral dimension, the floor vent further comprising a frame formed of one or more of the existing pieces of the flooring material, the frame having a substantially planar cosmetic upper face, a substantially parallel and substantially planar opposed lower face that are formed, respectively, of the upper and lower faces of the one or more existing pieces of the flooring material of which the frame is formed, the frame having a substantially uniform thickness measured in a thickness dimension perpendicular to the faces of the frame, the thickness of the frame being the same as the thickness of the grille insert, the frame having an insert-receiving opening therethrough, the insert-receiving opening having a minimum width measured in a third lateral dimension parallel to the faces of the frame and a minimum length measured in a fourth lateral dimension parallel to the faces of the frame distinct from the third lateral dimension, wherein the minimum width and minimum length of the insert-receiving opening of the frame is sufficient, relative to the corresponding maximum width and maximum length of the grille insert, to receive the grille insert so that the faces of the frame are co-planar with the corresponding faces of the grille insert.

18. The floor vent of claim 17, wherein the elongate structural members comprise metal and the flooring material does not comprise metal.

19. The floor vent of claim 4, wherein the elongate structural members are adhered to the cross-members with an adhesive.

20. The floor vent of claim 19, wherein the elongate structural members comprise metal and the flooring material does not comprise metal.

21. The floor vent of claim 4, wherein the elongate structural members comprise metal and the flooring material does not comprise metal.

* * * * *